US008251844B2

(12) United States Patent
Cross et al.

(10) Patent No.: US 8,251,844 B2
(45) Date of Patent: Aug. 28, 2012

(54) GOALKEEPER STICK WITH ANGLED SHAFT

(75) Inventors: David C. Cross, Highlands Ranch, CO (US); Jeffrey D. Cahill, Highlands Ranch, CO (US)

(73) Assignee: BOA Athletics, LLC, Highlands Ranch, CO (US)

( * ) Notice: Subject to any disclaimer, the term of this patent is extended or adjusted under 35 U.S.C. 154(b) by 134 days.

(21) Appl. No.: 12/792,219

(22) Filed: Jun. 2, 2010

(65) Prior Publication Data

US 2010/0323829 A1 Dec. 23, 2010

Related U.S. Application Data

(60) Provisional application No. 61/218,507, filed on Jun. 19, 2009.

(51) Int. Cl.
*A63B 59/14* (2006.01)

(52) U.S. Cl. ..... 473/560; 473/562

(58) Field of Classification Search ..... 473/560–563
See application file for complete search history.

(56) References Cited

U.S. PATENT DOCUMENTS

| | | | | |
|---|---|---|---|---|
| D263,329 | S | 3/1982 | Clayton | |
| 4,544,157 | A | 10/1985 | Curtis | |
| 5,456,463 | A | 10/1995 | Dolan et al. | |
| D406,625 | S * | 3/1999 | Hutzenlaub | D21/727 |
| 6,099,421 | A * | 8/2000 | Mayhew | 473/560 |
| 7,282,001 | B2 * | 10/2007 | Ponzini | 473/560 |

* cited by examiner

*Primary Examiner* — Mark Graham
(74) *Attorney, Agent, or Firm* — James C. Nemmers; Shuttleworth & Ingersoll, PLC

(57) ABSTRACT

A goalkeeper's hockey stick with an angled shaft is disclosed. The goalkeeper stick is comprised of a shaft, paddle and blade. The shaft connects to the paddle which connects to the blade. The portion of the shaft where it connects to the paddle is angled to the top portion of the paddle to provide a grip portion of the shaft where the goalkeeper's gloved hand can grip the stick in a way that the paddle and shaft can lay flat on the playing surface with no gap when the goalkeeper is in a defensive stance.

8 Claims, 4 Drawing Sheets

GOALKEEPER STICK WITH ANGLED SHAFT

CROSS-REFERENCE TO RELATED APPLICATIONS

This application claims priority under 35 USC 119 to Provisional Patent Application Ser. No. 61/218,507 filed on Jun. 19, 2009, the contents of which are hereby incorporated by reference.

BACKGROUND OF THE INVENTION

This invention relates to a hockey stick and more particularly to a hockey stick used by a goaltender or goalkeeper in the sport of ice hockey.

Sticks used by hockey players other than the goalkeeper are very similar, and their construction and design have not changed much over the years, being regulation by governing bodies such as the National Hockey League. The standard ice hockey stick is a piece of equipment used in ice hockey to shoot, pass, and carry the puck. Ice hockey sticks are approximately 65 inches long, composed of a long, slender shaft with a flat extension at one end called the blade. The blade is the part of the stick used to contact the puck, and is typically 15.5 inches long. Stick dimensions can vary widely, as they are usually built to suit a particular player's size and preference. The blade is positioned at roughly a 135° angle from the axis of the shaft, giving the stick a partly 'L-shaped' appearance. The shaft of the stick is fairly rigid, but it has some flexibility to benefit some shots. Also, the blade may be slightly curved in one direction, to aid in retaining or lifting the puck off the playing surface. This can be to the left or right, depending on the player's preference.

Most currently know sticks used by a goalkeeper are formed with a straight shaft attached to the center of a widened portion of the stick called a paddle. The paddle has a heel portion where it is joined to the blade, giving the hockey stick its somewhat L-shape. The goalkeeper has a slightly modified stick from the standard stick used by the other players. The lower part of the stick is wider, the angle is smaller, and the blade is slightly curved towards the direction of the play. According to NHL rules, the blade of the goalkeeper's stick cannot exceed three and one-half inches (3½") in width at any point except at the heel, where it must not exceed four and one-half inches (4½") in width; nor can the goalkeeper's stick exceed fifteen and one-half inches (15½") in length from the heel to the end of the blade. The widened portion of the goalkeeper's stick extending up the shaft from the blade ranges from 22 inches to 32 inches and can be not more that 3.5 inches in width.

The prior art discloses other inventions that have modified hockey goalkeeper sticks. For example, U.S. Pat. No. 5,456,463, (Dolan), describes a notched handgrip formed along a length of the shaft at a position between the widened shaft portion and the handle portion. However, this design constricts movement of the goalkeeper's hand along the shaft due to the ribbed handgrips on the shaft handle. In Dolan, the fingered handgrip prevents the hand from flowing smoothly along the shaft and does not allow sufficient space for clearance of the goalkeeper's gloved hand, which, together with the knob on the end of the shaft, prevents the shaft and paddle from laying horizontally on the playing surface.

U.S. Pat. No. 4,544,157 (Curtis) describes a goalkeeper's hockey stick having a bent shaft that can rest flush against the surface of the playing surface. Such a design, however, is impractical because the goalkeeper is unable to grip his or her fingers around the upper portion of the shaft while the stick is resting flush against the playing surface.

It is an object of the invention to solve the difficulties with the prior art goalkeeper hockey sticks by positioning of the angle on the shaft to allow for correct arm, hand and grip positioning of the goalkeeper in the defensive stance.

It is another object of the invention to remove finger grips from the angled portion of the shaft, allowing the goalkeeper's hand to flow along the angled portion of the shaft.

It is a further object of the invention to design the angled shaft so as to allow the paddle and shaft to lay horizontally on the playing surface, thus preventing the puck from passing under the paddle or shaft.

It is a further object of the invention to provide a goalkeeper's hockey stick with an ergonomic handgrip for ease of handling.

Yet another object of the invention is to provide a goalkeeper's hockey stick with a shaft that rests close to the playing surface when the stick is in a horizontal position, to prevent the passage of a puck under the shaft, but to provide sufficient clearance for the goalkeeper to grip the shaft of the stick.

SUMMARY OF THE INVENTION

According to the invention, a goalkeeper's stick is comprised of a shaft, a paddle and a blade. The portion of the shaft where it connects to the paddle is angled to the top portion of the paddle to allow the shaft and paddle to lay horizontally on the playing surface. The angled shaft provides clearance for the goalkeeper to grip that portion of the shaft with the goalkeeper's gloved hand while allowing both the paddle and the shaft to lay flat on the playing surface so as to block the puck.

DETAILED DESCRIPTION OF THE PREFERRED EMBODIMENTS

The goalkeeper stick show in drawings is a hockey stick for use by a goaltender or goalkeeper in the game of ice hockey.

Figure 2:
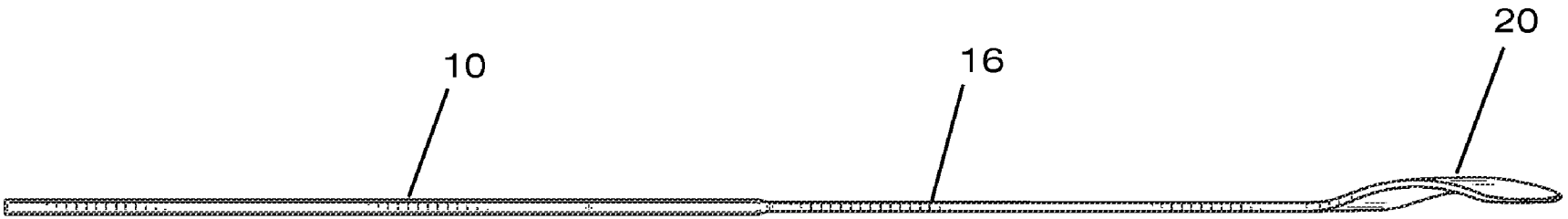
FIG. 2 is a front edge view of the stick of FIG. 1.

The stick of the invention is comprised of a long, straight shaft 10 having a relatively narrow cross sectional shape with a bottom edge and a top edge. The shaft angles upwardly to form a grip portion 12 that is joined to the top 14 of the rear edge 15 of a wider portion of the stick 10 called the paddle 16. The paddle 16 has a straight portion 17 and a heel 18 where the curved portion of the paddle 16 joins the blade 20. The straight portion 17 is in the same plane as the bottom edge of the shaft. The blade 20 has a height and thickness substantially the same as the paddle 16 and may be slightly curved as best seen in FIG. 2. From the straight portion 17 of the paddle 16 upwardly to where the grip portion 12 of the shaft 10 joins the paddle 16 the rear edge 15 is angled inwardly toward the paddle 16. The grip portion 12 thus forms an angled hand grip where the goalkeeper wearing a glove can grip the stick.

The shaft 10 can vary in length, but the following are the preferred dimensions of the stick. The stick usually is not more than 63 inches from the heel 18 to the end of the shaft 2. The grip portion 12 of the shaft 10 is about 8 inches in length so as to accommodate the gloved hand of the goalkeeper. The cross sectional dimensions of both the shaft 10 and the grip portion 12 are about 1.5 inches wide and 0.5 inches thick. The angled rear edge 15 of the paddle 4 is about 2 inches in length, while the length of the paddle 16 from the rear edge 15 to the heel 18 is about 26 inches. The height of the paddle is about 3.5 inches, and the height of the blade 20 is about 3.5 inches except at the heel 18 where it is about 4.5 inches. The length of the blade 20 from the heel 18 to the end of the blade is about 15.5 inches.

Figure 3:
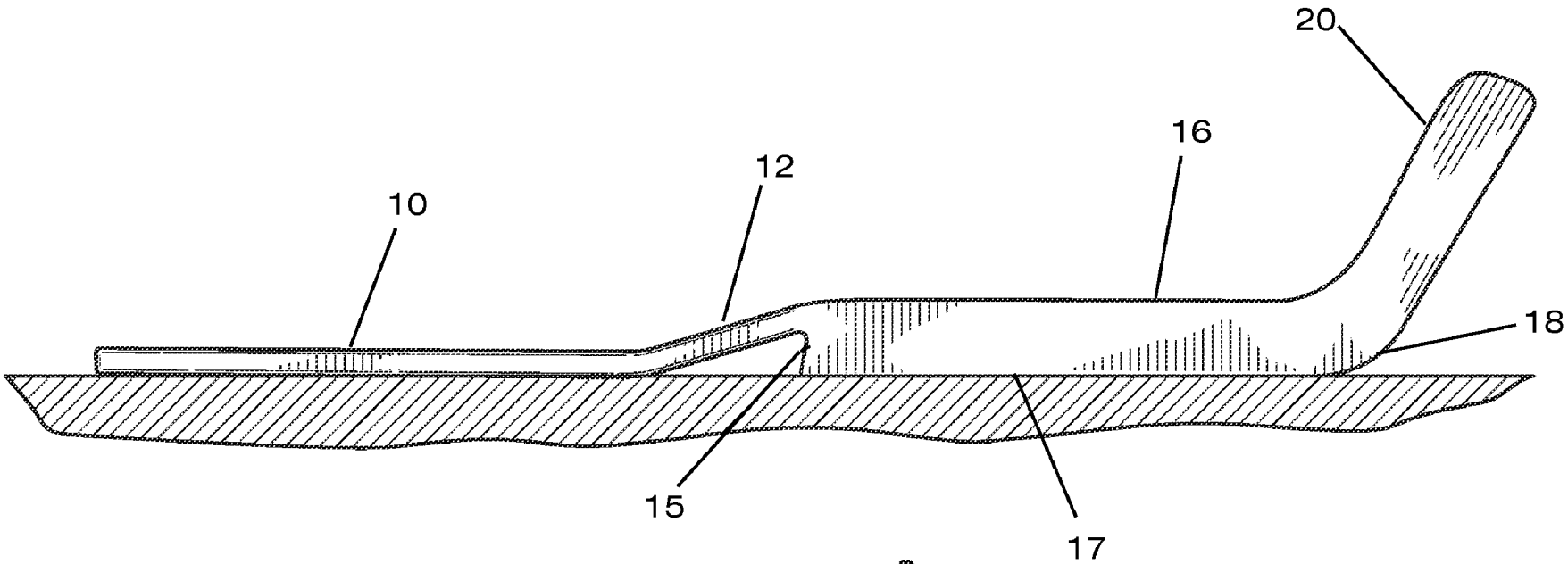
FIG. 3 is a view of the stick of FIG. 1 as it lays on the playing surface to illustrate how it is used to block a puck.

As illustrated in FIG. 3, when the stick is used by a goalkeeper to block a shot, the bottom edge of the shaft 10 and straight portion 17 of the paddle 16 are in the same plane and thus can lay horizontally on the playing surface with no gap between the stick anywhere and the playing surface. When a player, the goalkeeper, holds the shaft 10 at the grip portion 12, there is sufficient space beneath the grip portion 12 and the playing surface that the glove of the goalkeeper does not interfere with the shaft 10 and paddle 16 from being held flush with the playing surface. The cross sectional shape of the grip portion 12 is the same size as that of the shaft 10, which allows the player's hand to move smoothly along the entire shaft. Thus, the goalkeeper can quickly slide the gloved hand down the shaft 10 to the grip portion 12 and into the space created beneath the grip portion 12 against the angled portion 22.

Figure 1:
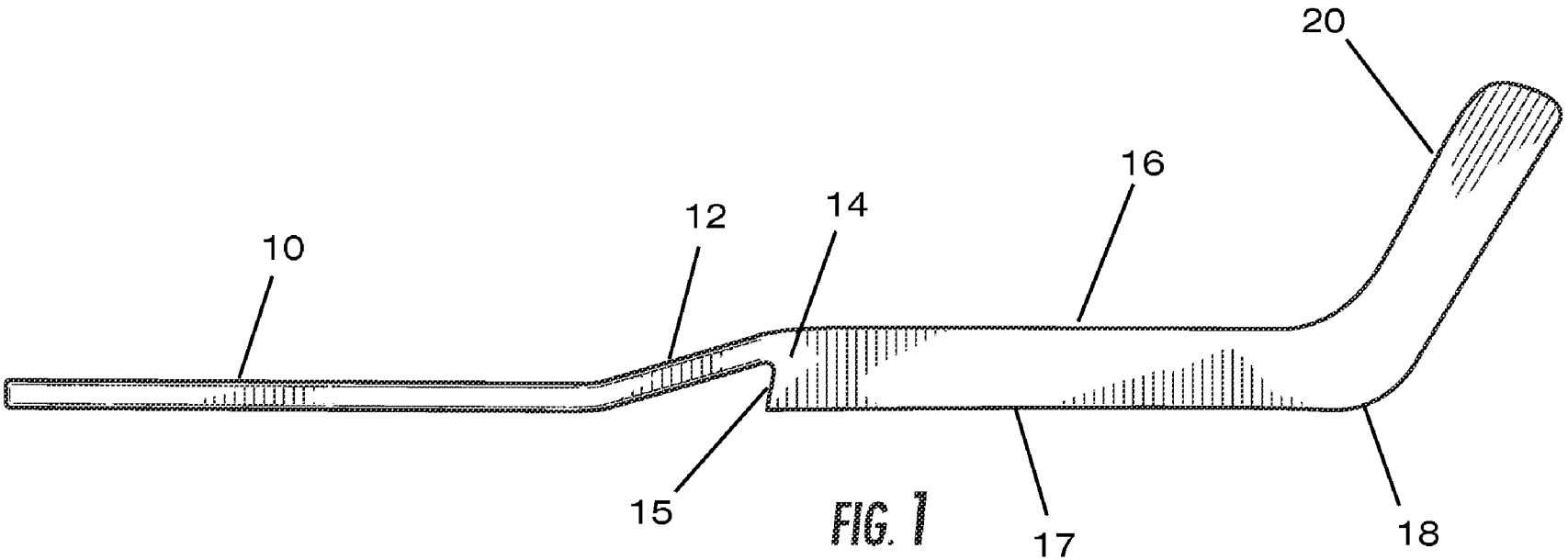
FIG. 1 is a side view of the goalkeeper stick of the invention.
Figure 4:
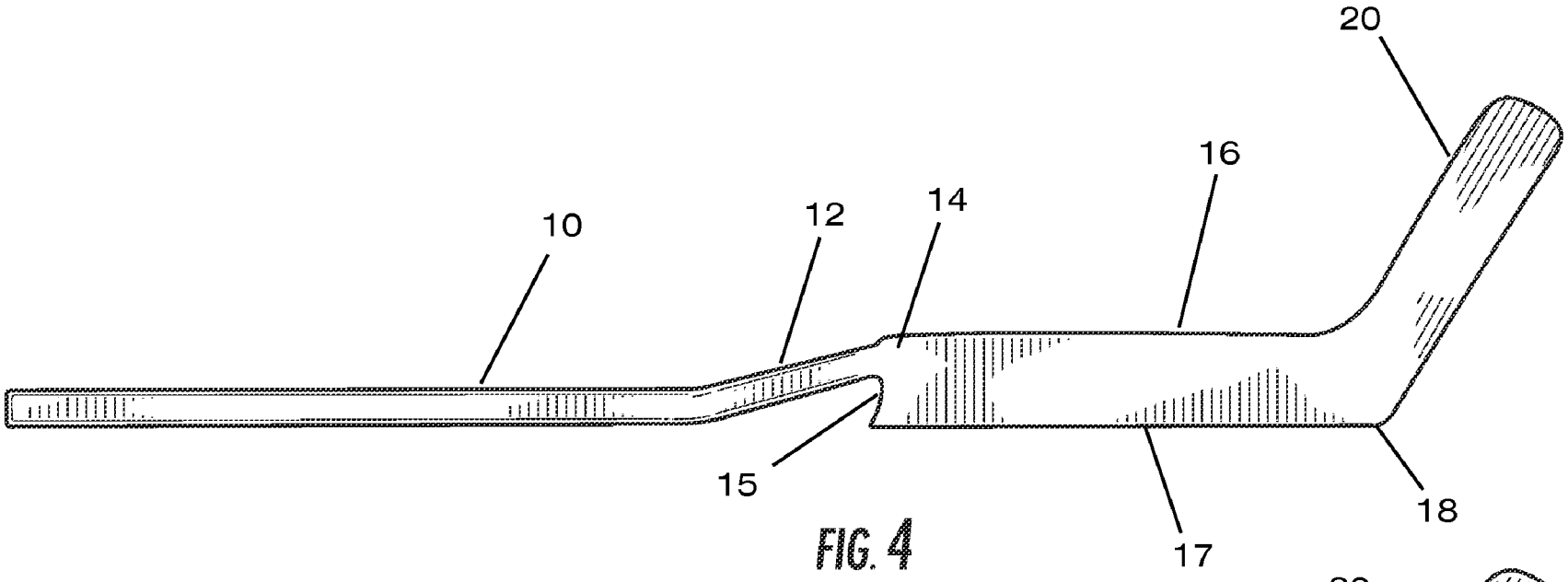
FIG. 4 is a side view of a stick similar to FIG. 1 but showing another embodiment of the goalkeeper's stick.

Referring now to FIG. 4, there is shown another embodiment of the invention. In this embodiment, the structure and dimensions of the hockey stick are substantially the same as the hockey stick of the first embodiment of FIGS. 1-3 with the following exceptions. Where the grip portion 12 is joined to the rear edge 15 of the paddle 16 has been lowered slightly form the top of the rear edge 15 and the rear edge is slightly concave to assist in maintaining the gloved hand of the goal keeper in place. This may also give a slightly different 'feel' of the stick by the player, but these modifications do not in any way alter the way in which the hockey stick is used by the player as described above with reference to the first embodiment.

Figure 5:
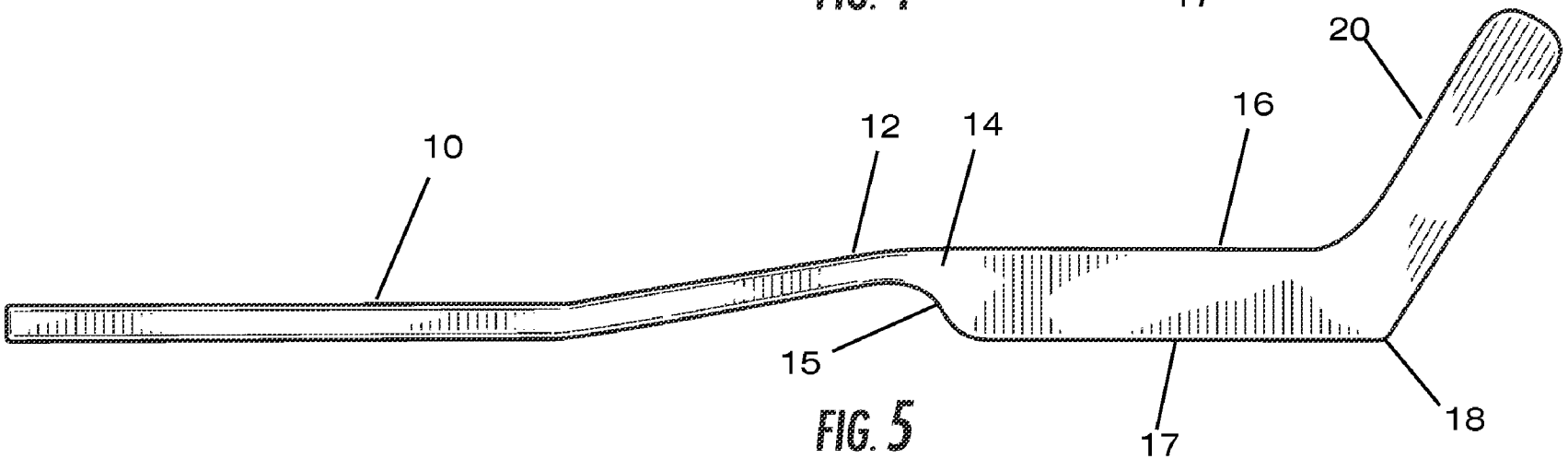
FIG. 5 is a side view of a stick similar to FIG. 1 but showing yet another embodiment of the goalkeeper's stick.

FIG. 5 shows yet another embodiment of the invention. In this embodiment, the structure and dimensions of the hockey stick are substantially the same as the hockey stick of the first embodiment of FIGS. 1-3 with the following exceptions. Similar to the hockey stick of FIGS. 1-3, the grip portion 12 is joined to the rear edge 15 of the paddle 16 at the top of the rear edge 15, but the rear edge 15 of the paddle 16 slopes inwardly toward the heel 18 of the paddle 16. This provides a slightly larger area for the gloved hand of the goal keeper and may provide a slightly different feel that some players prefer. However, these modifications do not in any way alter the way in which the hockey stick is used by the player as described above with reference to the first embodiment.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

The invention claimed is:

1. An angled hockey stick for use by the goalkeeper in playing hockey on a playing surface, the stick being comprised of;

a shaft having a bottom edge and a top edge;

a paddle having a first end and a second end and a top edge and a bottom edge;

the dimension of the shaft from its bottom edge to its top edge being substantially less than the dimension of the paddle from its bottom edge to its top edge with the shaft having an angled portion joined to the first end of the paddle to form a grip portion;

the bottom edge of the shaft and the bottom edge of the paddle being in substantially the same plane; and a blade combined with the paddle at the second end and angled upwardly from the paddle;

the grip portion of the shaft being substantially straight along the angled portion and extending from the bottom edge of the shaft to be joined to the first end of the paddle with the top edge of the shaft substantially aligned with the top edge of the paddle so as to form an enlarged space beneath the grip portion of the shaft and therefore provide an adequate space for the goalkeeper's hand to grip the shaft at the correct angle of the goalkeeper's arm while allowing the bottom edges of the paddle and shaft to lay on the playing surface with no gap between the bottom edges of the paddle and shaft when the goalkeeper is in a defensive stance.

2. The hockey stick of claim 1 in which the first end of the paddle is straight and angles inwardly toward the second end of the paddle from the bottom edge of the paddle so as to provide additional space for the goalkeeper's hand.

3. The hockey stick of claim 1 in which the first end of the paddle is convex and angles inwardly from the bottom edge of the paddle.

4. The hockey stick of claim 1 in which the first end of the paddle curves downwardly and inwardly toward the bottom edge of the paddle.

5. The hockey stick of claim 1 in which the grip portion of the shaft and the remainder of the shaft are the same cross-sectional shape to allow the goalkeeper's hand free movement along the full length of the shaft.

6. The hockey stick of claim 2 in which the grip portion of the shaft and the remainder of the shaft are the same cross-sectional shape to allow the goalkeeper's hand free movement along the full length of the shaft.

7. The hockey stick of claim 3 in which the grip portion of the shaft and the remainder of the shaft are the same cross-sectional shape to allow the goalkeeper's hand free movement along the full length of the shaft.

8. The hockey stick of claim 4 in which the grip portion of the shaft and the remainder of the shaft are the same cross-sectional shape to allow the goalkeeper's hand free movement along the full length of the shaft.

* * * * *